United States Patent [19]

Che

[11] Patent Number: 4,897,064

[45] Date of Patent: Jan. 30, 1990

[54] HEAD-FITTING SWIMMING APPARATUS

[75] Inventor: Shum H. Che, Kowloon, Hong Kong

[73] Assignee: Ever In Enterprises, Limited, Kowloon, Hong Kong

[21] Appl. No.: 284,758

[22] Filed: Dec. 12, 1988

Related U.S. Application Data

[63] Continuation of Ser. No. 109,300, Oct. 16, 1987, abandoned.

[51] Int. Cl.[4] ..... B63C 9/12

[52] U.S. Cl. ..... 441/124; 441/135; 128/201.11; 2/425; 2/427

[58] Field of Search ..... 441/80, 88, 124, 125, 441/135, 136; 128/201.11, 201.27, 202.14; 2/426, 427, 428, 435, 452, 425

[56] References Cited

U.S. PATENT DOCUMENTS

| | | | |
|---|---|---|---|
| 1,727,202 | 9/1929 | Greer | 128/201.11 |
| 2,534,568 | 12/1950 | Bedini et al. | 128/201.11 |
| 2,850,011 | 9/1958 | Schaefer | 441/124 |
| 3,064,646 | 11/1962 | Miller | 128/201.11 |
| 3,808,621 | 5/1974 | French | 441/135 |
| 4,533,335 | 8/1985 | Hoshino | 441/124 |
| 4,553,819 | 11/1985 | Correll | 441/135 |

FOREIGN PATENT DOCUMENTS

| | | | |
|---|---|---|---|
| 907801 | 8/1922 | Canada | 2/425 |

*Primary Examiner*—Sherman D. Basinger
*Assistant Examiner*—Stephen P. Avila
*Attorney, Agent, or Firm*—Flehr, Hohbach, Test, Albritton & Herbert

[57] ABSTRACT

A swimmer's face mask (1) comprising a visor (3, 4 and 5), a holder (6) for the visor (3, 4 and 5) and a strap (7) for attaching the holder (6) to the face of a swimmer. The visor (3, 4 and 5) is of transparent plastic material and has two laterally extending panels (3, 4 and 5) sealed at their edges to form a hollow water-tight compartment (13). This compartment (13) provides sufficient buoyancy to float the entire face mask (1) when it is detached from the head of a swimmer.

3 Claims, 1 Drawing Sheet

HEAD-FITTING SWIMMING APPARATUS

This is a continuation of application Ser. No. 109,300 filed Oct. 16, 1987, now abandoned.

FIELD OF THE INVENTION

The invention relates to a head-fitting swimming apparatus, for attachment to the head of a swimmer, which can float by itself at the surface of water when detached from the swimmer's head.

BACKGROUND ART

Known head-fitting swimming apparatus, such as swimmers' face masks and breathing tubes, for attachment to the head of a swimmer, comprise one or more components and, conventionally, such apparatus is not buoyant and therefore may easily get lost when detached from the swimmer's head during swimming.

DISCLOSURE OF THE INVENTION

It is the purpose of the present invention to make head-fitting swimming apparatus buoyant so as to avoid the problem of losing such apparatus when detached from the swimmer's head during swimming.

This is achieved by providing that at least one component is buoyant; and one buoyant component alone or two or more buoyant components together provide sufficient buoyancy to float the whole apparatus when detached from the swimmer's head.

Thus, according to the present invention, there is provided a head-fitting swimming apparatus, for attachment to the head of a swimmer, comprising one or more components, at least one of which is buoyant, and wherein one buoyant component alone or two or more buoyant components together provide sufficient buoyancy to float the whole apparatus when detached from the swimmer's head.

One possible way to make head-fitting swimming apparatus buoyant is to fabricate it or its components from buoyant materials, that is, those material whose densities are less than that of water, to such an extent that the whole apparatus become buoyant when detached from the swimmer's head. However, the manufacturing cost of such apparatus would be much higher than that of the ordinary ones because of the use of new materials and new manufacturing processes. Furthermore, the mechanical strength of such apparatus may also be reduced by the use of such low density materials.

Therefore, in a preferred embodiment of the invention, at least one buoyant component is formed with a hollow and water-tight compartment. Buoyancy is achieved by the displacement of water by the air inside the compartment and the component can be formed of strong and/or rigid material.

In a swimmer's face mask embodying the invention, the buoyant component is the transparent visor. The visor has a first laterally extending transparent panel and a second laterally extending transparent panel having an outer edge portion which is sealed to the first panel to form said water-tight compartment. In this manner air is trapped inside said compartment to provide buoyancy. The double panel structure of the visor can also improve rigidity.

Similarly, a breathing tube embodying the invention may have elongate inner and outer tubes and two annular stoppers disposed between the inner and outer tubes to provide said water-tight compartment in the form of an annular-section air space between said stoppers. Here again, air is trapped inside said compartment to provide buoyancy.

An embodiment of the invention is hereinafter described, by way of example, with reference to the accompanying drawings.

MODE FOR CARRYING OUT THE INVENTION

Figure 1:
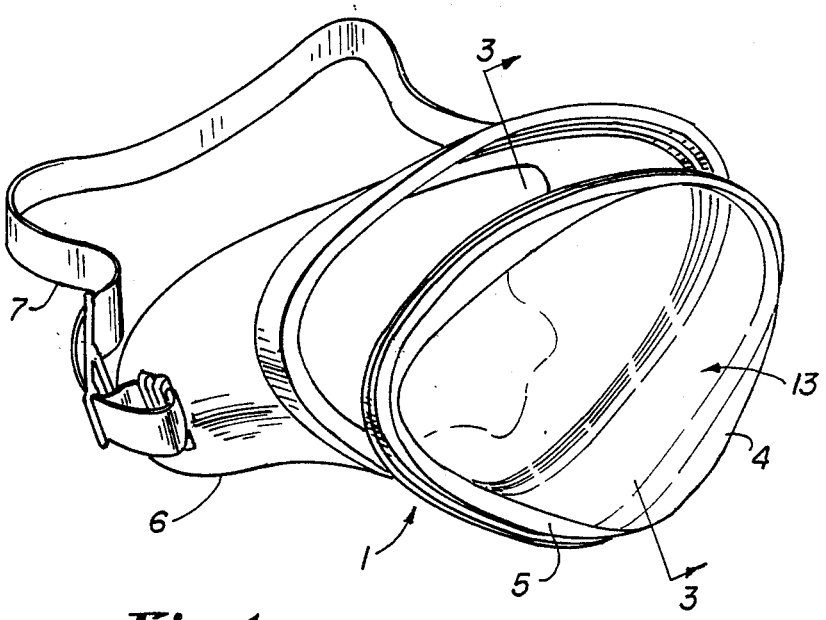
FIG. 1 is an exploded perspective view of a swimmer's face mask embodying the present invention.

Referring to FIG. 1, the swimmer's face mask 1 shown therein comprises a hollow visor 3, 4 and 5 comprising a first laterally extending transparent panel 3 and a second laterally extending transparent panel 4 having an outer edge portion 5, a visor holder 6, and a strap 7 for attaching the face mask 1 to the swimmer's head.

Figure 3:
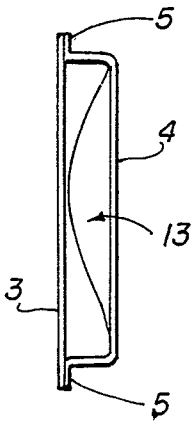
FIG. 3 is a cross-sectional side elevation of a visor forming part of the first embodiment, taken across the line III—III in FIG. 1.

As shown in FIG. 3, the first and second laterally extending transparent panels 3, 4 and 5 are sealed at their edges to form a hollow water-tight compartment 13 which provides sufficient buoyancy to float the entire face mask when detached from the head of a swimmer.

Figure 2:
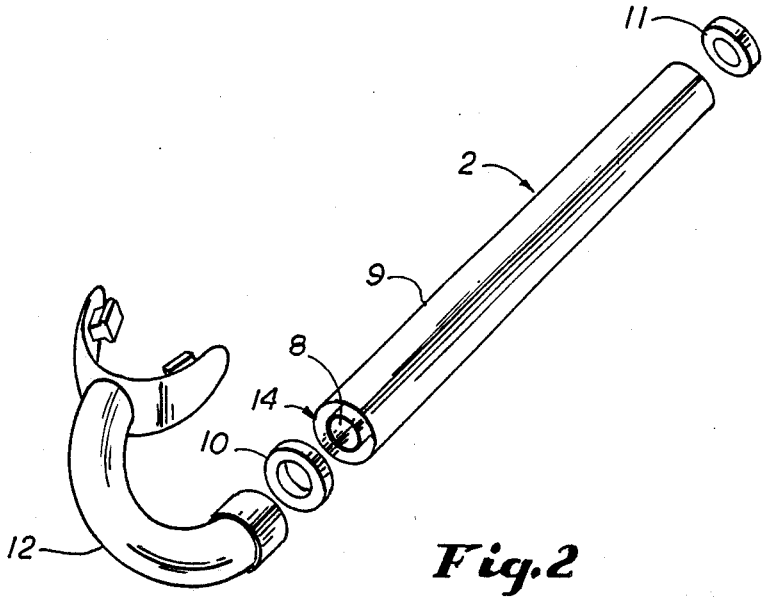
FIG. 2 is an exploded perspective view of a breathing tube embodying the present invention.

Referring to FIG. 2, the breathing tube 2 shown therein comprises elongate inner and outer tubes 8 and 9, two annular stoppers 10 and 11, and a mouth-piece tube 12.

As shown, the two annular stoppers 10 and 11 are disposed between the inner and outer tubes 10 and 11 to form a hollow water-tight compartment 14 which provides sufficient buoyancy to float the entire breathing tube when detached from the head of a swimmer.

Finally, for the two items 1 and 2 of head-fitting swimming apparatus embodying the present invention, as hereinbefore described, while they must have at least one buoyant component 3 to 5 or 8 to 11, it need not necessarily be the visor 3 to 5 or the main tube 8 to 11, respectively, it could for example be the visor holder 6 or the mouthpiece tube 12 respectively.

I claim:

1. In a face mask for use on the head of a swimmer for covering a substantial portion of the head of the swimmer, a visor having at least a transparent portion, a visor holder carrying the visor and strap means secured to the visor holder for attaching the same to the head of the swimmer, so that water is substantially inhibited from entering between the visor holder and the head of the swimmer whereby the swimmer has relatively clear vision through the visor, said visor holder only enclosing the frontal portion of the heat of the swimmer, said visor being comprised of first and second spaced-apart transparent panels having outer margins and means for securing the outer margins of the panels to form a rigid unitary assembly and to provide a permanent water-tight compartment between the panels, said water-tight compartment being of sufficient size to provide a buoyancy sufficient to float the face mask in water when it is detached from the head of the swimmer.

2. A face mask as in claim 1 wherein said panels are substantially parallel.

3. In a breathing tube assembly for use on the head of a swimmer, a mouthpiece adapted to be inserted into the mouth of the swimmer, an elongate breathing tube secured to the mouthpiece and an outer tube surrounding the breathing tube and extending substantially the entire length thereof, means securing the outer tube to the breathing tube to form a watertight compartment between the breathing tube and the outer tube which provides sufficient buoyancy to float the breathing tube assembly when it is detached from the head of the swimmer, said outer tube extending coaxially of the breathing tube, said means securing the outer tube to the breathing tube including annular stoppers disposed at opposite ends of the breathing tube and outer tube to form the watertight compartment.

* * * * *